United States Patent [19]

Sidwell

[11] Patent Number: 4,936,771

[45] Date of Patent: Jun. 26, 1990

[54] SKID MARK ERASURE SYSTEM

[76] Inventor: Clarence W. Sidwell, 320 Fort Duquesne Blvd., Pittsburgh, Pa. 15222-2363

[21] Appl. No.: 369,345

[22] Filed: Jun. 15, 1989

Related U.S. Application Data

[63] Continuation-in-part of Ser. No. 089,406, Aug. 26, 1987, abandoned, which is a continuation-in-part of Ser. No. 886,117, Jul. 16, 1986, abandoned.

[51] Int. Cl.[5] ..... F27D 3/04; F27B 9/14

[52] U.S. Cl. ..... 432/127; 432/133; 432/146; 432/234

[58] Field of Search ..... 432/121–123, 432/126–130, 146, 5, 153, 6, 234, 10

[56] References Cited

U.S. PATENT DOCUMENTS

| | | | |
|---|---|---|---|
| 2,776,128 | 1/1957 | Nesbitt et al. | 432/234 |
| 2,927,783 | 3/1960 | Bloom et al. | 432/133 |
| 3,148,868 | 9/1964 | Sidwell | 432/146 |
| 3,291,465 | 12/1966 | Wilde | 432/146 |
| 3,296,039 | 1/1967 | Loeck et al. | 432/127 |
| 3,342,468 | 9/1967 | Sidwell | 432/127 |
| 3,387,834 | 6/1968 | Brichmont et al. | 432/127 |
| 3,575,395 | 4/1971 | Gentry | 432/146 |
| 3,612,498 | 10/1971 | Voigt | 432/146 |
| 3,632,093 | 1/1972 | Elhaus | 432/146 |
| 3,637,198 | 1/1972 | Knaak | 432/234 |
| 3,804,584 | 4/1974 | Herr | 432/234 |
| 3,851,091 | 11/1974 | Laws | 432/127 |
| 4,243,402 | 9/1978 | Sensi . | |
| 4,464,831 | 8/1984 | Weber et al. | 432/10 |
| 4,620,840 | 11/1986 | Hilge et al. | 432/121 |

*Primary Examiner*—Henry C. Yuen

*Attorney, Agent, or Firm*—Webb, Burden, Ziesenheim & Webb

[57] ABSTRACT

The invention is directed to an arrangement of high thrust burners with control systems for a heating furnace which heat metal or similar product, in order to erase developing cold skid marks. The location of these burners is specified, transversely and longitudinally as well as their position with the product face. This invention considers the flow of gases inside of the furnace and the necessary burner characteristic required for the application of these burners to the developing skid marks and the reasons for the specifications. The burners are required to be such that the maximum available heat in the flame is applied at the spot required in order to heat those spots at a faster rate than the cooling effect of the water cooled parts, which are the initial causes of the cold spots. Moreover, it is specified as to the control systems and to the part in which they play in the operation of the skid mark erasure burners.

2 Claims, 2 Drawing Sheets

SKID MARK ERASURE SYSTEM

This application is a continuation-in-part of application Ser. No. 07/089,406, filed Aug. 26, 1987,abandoned which is a continuation-in-part of application Ser. No. 06/886,117, filed on July 16, 1986, now abandoned.

BACKGROUND OF THE INVENTION

The present invention relates generally to apparatus for heating steel or other metal in a semi-continuous type reheat furnace which heats the product in one or more rows and discharges the heated product for further processing.

Reheat furnaces can generally be described as batch type, continuous, and semi-continuous.

The batch type reheat furnace is represented by the solid brick hearth furnace which receives product in several pieces at substantially the same time, they are heated altogether, and each is drawn from the furnace as required by the process, the remaining pieces are stored until needed.

The continuous reheat furnace is a type of furnace where long product pieces are rolled continuously through the furnace of 300 to 400 feet long, and thus the longitudinal line of the furnace and the steel are coincident. Also, this type of furnace is so long, that there is insufficient room for the waste gases to flow inside of the furnace. As shown by Wilde, U.S. Pat. No. 3,291,465, these gases are ducted off to the side and do not present any interference to the flow of heating flames.

A semi-continuous reheat furnace may have one to three rows of furnace product present in the furnace at one time while being heated from a cold condition to a temperature of about 2200 degrees Fahrenheit. The steel temperature depends on the position as the product advances through the furnace. There are several heating zones in this type of reheat furnace followed by a soaking zone. The soak zone is especially designed to mitigate temperature differences in the product, for example, between the outer surface and the center, or between the edges and the center, with burners which provide a greater spread of radiating energy more or less evenly over all of the product. This soak zone is equipped with a firing rate capability which is considerably less than the heating zones, because the purpose of the soak zone, is that of evening out temperature differences. To the extent that there are cold skid marks on the product as it enters the soak zone, these are generally not erased and in order to do so, it is necessary to delay furnace production so that this zone may accommodate this condition.

One such type of semi-continuous reheat furnace is the five-zone furnace disclosed in the Sidwell U.S. Pat. No. 3,148,868. This patent is an attempt to improve five-zone average furnace productivity, by the judicious placement of preheated air.

A conventional way of advancing the work in the furnace is by pushing each entering piece of work into the entry end of the furnace causing it to engage and push forward the line of working pieces ahead, which are already undergoing heating and soaking. The foremost in such heating line is discharged contemporaneously with, and by the entry of a fresh workpiece.

Another way of advancing the work, is to push the workpiece onto water-cooled mechanical walking beams, which space the work, one from the other. From thence, the work will advance as it is walked through the furnace. This mechanism inside the furnace adds additional water-cooled members.

Thus, the definition of a semi-continuous furnace, because of the distance of each movement is only as far as it is necessary to discharge the foremost piece onto the mill tables. Then the process halts until another demand for another piece of steel is required.

In the process of heating, the steel rests on skid bars supported by water-cooled pipes. To conserve heat, the water pipes are insulated, the effective condition of the insulation varies during a furnace campaign.

The normal passage of steel through the furnace is subject to delays in production on one hand or to high production rates on the other because of high or low mill demand, causing the steel to rest on the skids for varying time periods.

In addition, one or more of the rows of steel inside of the furnace, may, for various reasons be delayed with respect to another row, so that it sits idly in the furnace while another row is being pushed to an excessive rate.

As may be seen, the cold skid marks form on the product as soon as the product rests on any water-cooled skid bar for any appreciable period of time.

The heating zones are each provided with a conventional control means which controls a multiplicity of burners that are designed and adjusted to fire evenly and to heat the entire compliment of workpieces in that zone as determined by the control setting.

Also of importance is the part that the flames play inside the furnace. The flames are developed in an area well over the top of the product. This may be done by the utilization of either long, short, or radiant burners. The burner choice depends on the furnace design. In any case, the flames are completely developed over the product in a combustion space. No combustibles are carried over into the next zone or into the exhaust flue.

The soak zone fires flames which develop an even heating head to the product. Subsequent zones then contain exhaust gases from the previous zones. Thoroughly fixed into the exhaust gases are diatomic gases. These absorb heat from the zone burners as they pass through a zone and they then rereadiate some of it to the steel. These exhaust gases are not only underneath the firing flames but are also cooler than the flames because of their closeness to the cold steel. This provides eveness of heat being transferred to the steel. In addition, the exhaust gases flow counter to the product flow. This counter flow provides convection heat from the gases to the colder steel.

In operation, the individual rows of steel product are individually subject to independent combinations of push and dwell periods as they progress through the zones and ultimately to the discharge. The periods of push and dwell are mutually independent of each other and are controlled by mill operations. The amount of push depends on the width of the product that must be discharged form the furnace. As described above, the workpieces progress through the zones, not in a slow continuous manner as in the continuous furnace, but in a halting manner. Thus, in an example of two rows of slabs, one row of slabs is pushed forward approximately four feet, causing the leading slab to be discharged. Even though the following colder pieces of steel enter the zones following a discharge, the firing rates continue almost unchanged because of the heat lag inherent in the steel and brickwork already in that zone and the resting time available to the colder piece.

It may readily be seen that the temperature control described above in any particular zone maintains primarily an average kind of temperature control supervision over the fuel firing in that zone, and cannot react nor accommodate localized cold areas in the zone, such as a skid mark.

Conventional heating practices commonly are unable to respond in full correspondence with the heating demand due to production requirements. Temperature uneveness or deficiency may result, particularly in the soak zone where it may not be possible to even out the steel temperature and erase the harmful skid marks. Also, when there is a delay in the furnace due to mechanical troubles, or mill delay, even though the firing rate in the heating zone may be cut back, there may be overheating and underheating of the steel because of excessive resting time of the steel on the water-cooled skids. Finally, when demand increases, the steel delivered onto the soaking hearth is generally heavily skid marked.

SUMMARY OF THE INVENTION

My invention comprehends a method and apparatus suitable for erasing skid marks in a semi-continuous preheat furnace as they form when entering each zone or after their formation, all by the judicious utilization of burners firing special flames which are higher in temperature than the ambient temperatures. In addition, the flames are of high thrust to overcome the exiting flue gas velocity and specifically applied at the developing skid marks. These burners and controls discriminate between rows of slabs and zones. Further, these burners are applied in the sloping areas throughout the furnace or where flame development can be most effective to the Skid Mark Erasure, and as required even to the application of these hot flames to the underside of the workpiece and the entry end.

More specifically, the present invention comprises a plurality of high thrust burners positioned in a wall of the furnace spaced above the hearth and aligned in spaced-apart longitudinally extending arrays above each of the stationary water-cooled skid rail bars and adapted to direct high velocity flames on the top surface of the metal product directly above each of the skid rail bars to prevent or erase a cold skid mark.

Additionally, specialized temperature controls are provided separate from the main burners', controls, for one or more points in the furnace both transverse and longitudinally, in order to accommodate the differences in the rows of steel or other furnace conditions, such as insulation integrity. These controls also would adjust for and recognize mill delay, or high production rate phases in order to erase the developing skid marks which would otherwise normally imbed themselves as in a conventional furnace design.

The extremely hot high thrust flames are achieved by providing a pair of flames impinging against each other at angles of 75° to 85° from the horizontal, or by oxygen enriched or oxy-fuel burners, burners of the regenerative type, liquid or solid fuel, or any similar burners with high thrust that can provide and direct heat at the desired spot.

In addition, the present invention overcomes the following problems:

At high productivity, there is insufficient time for the steel to sit on the soak zone for a required period of time in order to soak out the skid marks as required for quality product. The skid mark erasure burners, therefore, can provide the desired excess productivity without delay.

During a production delay or reduced productivity, low demand causes the steel to spend time sitting in the heating zones allowing for a greater and deeper absorption of skid marks than would be expected under furnace design production rates. As the steel enters subsequent zones, the skid mark erasure burners equalize the steel so that it may proceed as required without undue delay.

The skid mark erasure burners must be controlled in individual groups but separately from the main burners in any zone and from any other row of steel flow to provide firing flexibility. Erasure of any developing or developed skid marks in any row may then be easily accommodated without undue delay of furnace productivity, or upsetting heat distribution in that zone.

Furthermore, since heating problems may occur on any of the rows of steel in the furnace, exclusive of the other rows, this invention recognizes that the skid mark erasure system can be applied to any or all of the rows, as required.

In addition, due to the multiplicity of rows which are charged into the furnace, this invention will assist the furnace production quality regardless of the speed of the flow of material in the furnace.

DESCRIPTION OF THE PREFERRED EMBODIMENT

Figure 1:
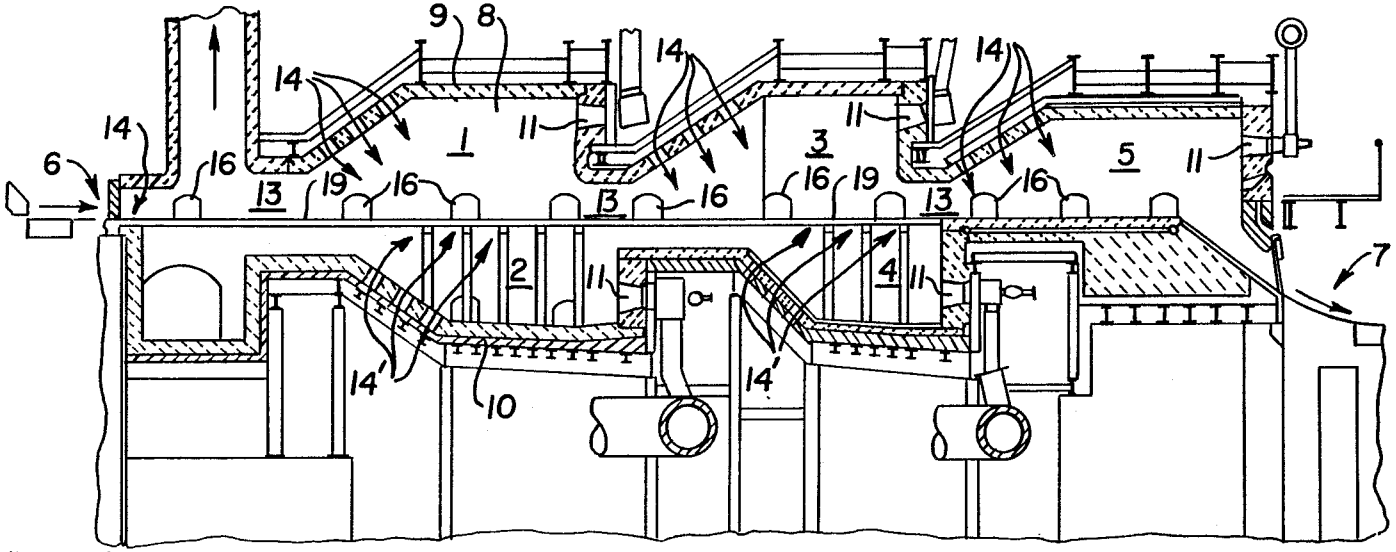
FIG. 1 is a longitudinal cross-section of a five-zone pusher type reheat furnace fitted with burners in accordance with the present invention.

FIG. 1 depicts a typical semi-continuous reheat furnace including zones 1, 2, 3, 4, and 5, with zone 5 being the soaking zone. The cold steel in the form of slabs 16, for example, is charged into the furnace at a charge end 6, and is later discharged from the furnace in a preheated condition at discharge end 7. A combustion chamber 8 is located in zone 1 with similar combustion chambers being located in the other furnace zones 2–5. The flames from a multiplicity of main zone burners develop in the combustion chamber 8, between the roof 9 and floor 10. The main burners 11 in each zone provide overall heating for that zone and are controlled by a zone temperature controller. The flue gases from the previous zones flow through restrictions 13 to exhaust at uptake conduit 12. A characteristic of these flue gases is to absorb radiant heat and then rereadiate heat from the particular zone burners 11 to help provide eveness of heating. The gases from completed combustion combine with other gases from the other zones and exit from the zone into the exit portion of the zone at area 13.

One of several longitudinal rows of skid mark erasure burners 14 of the present invention is provided in each zone of the furnace and adjacent the entry end 6. The burners 14 are positioned in longitudinally spaced-apart arrays and are aligned over each of the stationary water-cooled skids 19. The steel travels along the furnace atop of the water-cooled skid rails 19 as will be described hereinafter.

As also described in background art, main soak zone burner firing via burners 11 is especially designed to develop uniform heat for radiation so as to even out product temperature variations. Subsequent downstream zones receive the exhaust gases from the previous zones. Because of this, high thrust burners are required to penetrate the layer of exhaust flue gases in order to reach the surface of the metal product 16. The present invention incorporates a plurality of high thrust burners 14 in separate rows and which generate high flame velocities that drive through the ever present flue gas streams to prevent interference from these gases in the performance of the skid mark erasure process. The hottest flames of each burner terminate at the steel surface positioned directly over the cold skid mark areas, or under the product face along the stationary water-cooled skid support rails 19. Bottom firing is depicted in FIG. 1 with high thrust burners 14'.

Figure 2:
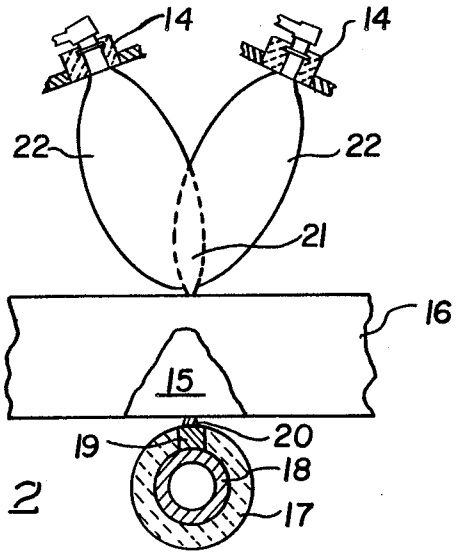
FIG. 2 is a partially fragmented end sectional view of a water-cooled skid supporting a piece of metal product having an embedded cold skid mark therein shown with a pair of burners of the present invention.
Figure 4:
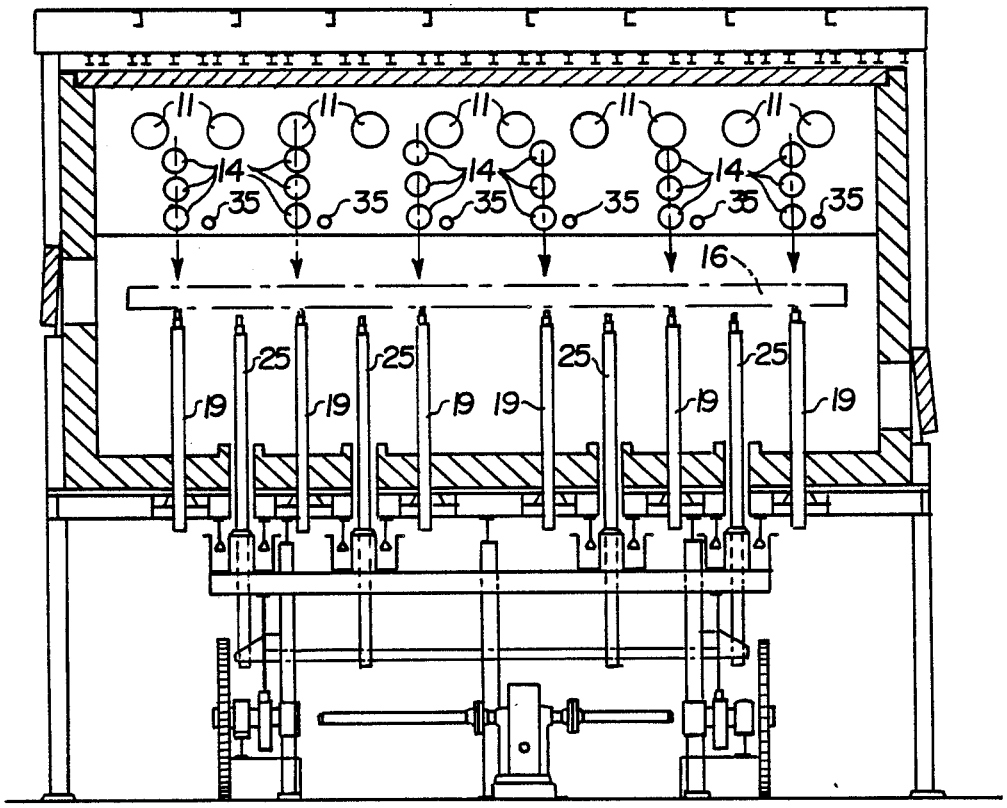

FIG. 2 shows a developing cold skid mark 15 on a steel slab 16, for example, in the process of being heated in the furnace of FIG. 1. The cold skid mark 15 is usually caused by excessive dwell time on the water-cooled skid pipe 18 which has a layer of insulation 17 thereabout. The heat from the steel is extracted by conduction through the skid rail 19 and wear rail bead 20 to the water-cooled skid pipe. As shown in FIG. 4, a typical reheat furnace may contain six such spaced-apart stationary skid rails 19.

FIG. 2 also depicts a presently preferred burner pair 14, which is diagrammatically shown in FIG. 1, firing on top of the steel slab 16. The burner pair 14 produces a spot-type heating provided by the hottest part of the flame 21 which has developed by being insulated from the cooler furnace by the outer shielding of developing flames 22. This hot flame 21 is necessary to overcome the cold skid mark. FIG. 1 also shows that burners 14', are being fired from underneath the skids 19. It should be recognized that the orientation of top burners shown are for illustrative purposes and may be turned 90 degrees to that as shown in order to provide the least interference and resistance to the flow of gases passing along the steel surface from front to back of the furnace, as described in FIG. 1. Furthermore, the burner pair shown in FIG. 2 comprises one of a plurality of longitudinally extending groups of burners 14 shown in FIG. 1.

Figure 3:
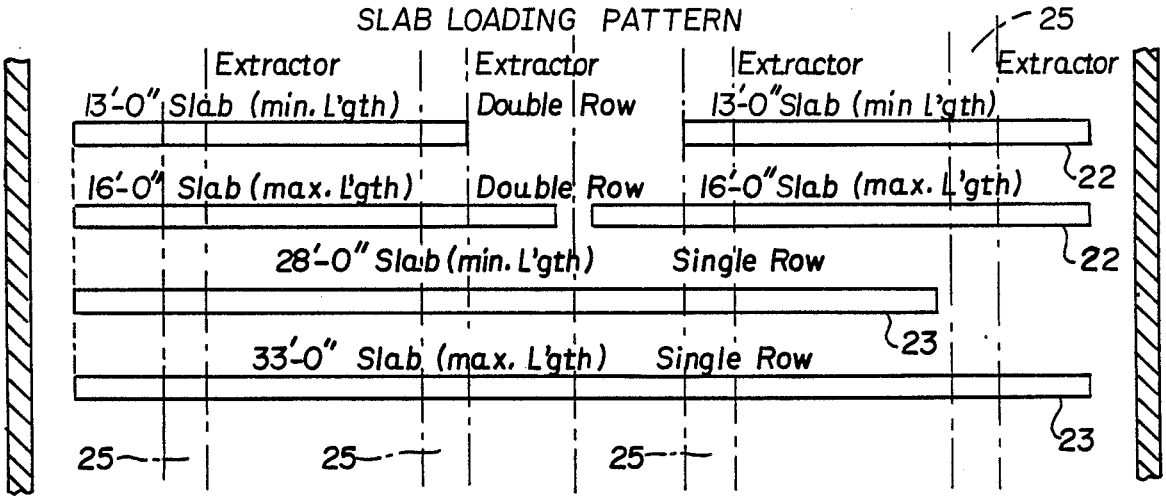
FIG. 3 is a top plan schematic view of a portion of a preheat furnace hearth depicting several typical steel loading patterns; and, FIG. 4 is a cross-sectional end view of a walking beam preheat furnace showing burners of the present invention therein.

FIG. 3 indicates the variety of loading patterns available using four variations of steel charging patterns 22 and 23. FIG. 4 indicates the number of longitudinally extending, parallel, spaced-apart water-cooled skid bars 19 which are positioned inside of a typical walking beam furnace. The types of supports are the stationary support skid type 19, and the moveable type 25. An arrangement of skid mark erasure burners are schematically indicated at 14. While single, longitudinally extending arrays of burners 14 are depicted in FIG. 4, it is, of course, understood that these burners can each be the converging burner pairs 14 shown in FIG. 2. As seen in FIG. 4, the arrays of burners 14 direct their respective high velocity flames downwardly to contact the steel slab 16 along each of the water-cooled skid rails 19. The main zone burners 11 shown in FIG. 4 are simultaneously firing outwardly in a direction normal to the plane of the upper surface of the slabs 16.

FIG. 3 indicates the necessity of providing individual longitudinal burner control systems because in certain furnace loadings, it is appreciated that not all of the water-cooled skids 19 will have slabs located thereon. This is particularly true when the furnace is preheating the shorter 13 and 16 foot slabs which may only be present on one side of the furnace. In addition, the functional condition of the support skid insulation 17, of FIG. 2, directly influences the formation of skid marks. If the insulation is new and in good condition, there may be no cold skid marks formed on the supported slabs 16. On the other hand, if the insulation 17 is in poor condition, skid marks will form more rapidly. A suitable control means (not shown) having optical pyrometric sensors 35 placed at intervals along the furnace hearth, for example, could be employed to detect the presence of cold skid marks on slabs 16 on a given set of skid rails 19 and selectively activate only those burners 14 located over the affected slabs. Conversely, when a particular slab has no skid marks, the sensor 35 would send an appropriate signal to the control means 30 for selective deactivation of those burners 14 above the unmarked slabs. The deactivated burners 14 would remain in the deactivated state until such time as the sensor 35 again detects the presence of a cold skid mark area on a later slab.

Furthermore, it is understood that the control systems must operate independently of the zone control systems so that the erasure system can accommodate the various operating conditions in a furnace.

I claim:

1. In a reheating furnace of the type having a charging end and a discharge end and a hearth extending between said ends and walls defining a plurality of combustion zones above and below said hearth extending a distance from said charging end, a soaking zone above said hearth adjacent said discharge end, a plurality of combustion burners in each of said zones directed toward said charging end and a plurality of parallel spaced-apart, water-cooled support rails longitudinally extending along said hearth adapted to support metal shapes thereon, wherein the improvement comprises:

high thrust burner means positioned in a wall of the furnace spaced above the hearth and comprising a plurality of high velocity burners aligned in longitudinally extending, spaced-apart arrays, positioned above each of the water-cooled support rails and adapted to direct a high velocity flame on a top surface of said metal shapes directly above each of said longitudinally extending rails supporting said metal shapes, whereby a preexisting cold skid mark condition is eliminated or is prevented from forming on said metal shapes;

said high thrust burner means including a plurality of spaced burner pairs, each of said burner pairs being aligned in a converging manner whereby a flame developed by each burner overlaps one another to produce a high temperature flame impingement spot on said metal shape;

sensing and control means associated with the high thrust burner means to permit selective activation of a number of high velocity burners positioned above support rails having metal shapes supported thereon in which cold skid marks are detected by said sensing means; and including additional high thrust burner means positioned below the hearth and adapted to direct high velocity flames on a bottom surface of said metal shapes adjacent said skid rails supporting said metal shapes.

2. In a reheating furnace of the type having a charging end and a discharge end and a hearth extending between said ends and walls defining a plurality of combustion zones above and below said hearth and extending a distance from said charging end, a soaking zone above said hearth adjacent said discharge end, a plurality of reheat combustion burners in each of said zones directed toward said charging end and a plurality of parallel spaced-apart, water-cooled support rails longitudinally extending along said hearth adapted to support semi-finished metal shapes thereon, wherein the improvement comprises:

high thrust burner means positioned in a wall of the furnace spaced above the hearth and comprising a plurality of high velocity burners aligned in a longitudinally extending, spaced-apart array positioned above each of the water-cooled support rails and adapted to direct a high velocity flame on a top surface of said metal shapes directly above each of said longitudinally extending support rails supporting said metal shapes;

sensing and control means for the high thrust burner means to detect the presence of cold skid marks and permit selective activation of a number of high velocity burners positioned above metal shapes having cold skid marks detected thereon and for selective deactivation of a number of high velocity burners positioned above the metal shapes having no skid marks detected thereon;

said high thrust burner means including a plurality of spaced burner pairs, each of said burner pairs aligned in a converging manner such that a flame developed by each overlaps one another to produce a high temperature flame impingement sport on said metal shape; and additional high thrust burner means positioned below the hearth and longitudinally aligned along each of said support rails adapted to direct high velocity flames on a bottom surface of said metal shapes adjacent said support rails supporting said metal shapes.

* * * * *